US006662532B1

(12) United States Patent
Droog et al.

(10) Patent No.: US 6,662,532 B1
(45) Date of Patent: Dec. 16, 2003

(54) BAG FILLING APPARATUS AND METHOD

(75) Inventors: Thomas W. Droog, Bow Island (CA); Stephen A. Withington, Calgary (CA); Douglas Greening, Calgary (CA)

(73) Assignees: Alberta Sunflower Seeds, Ltd., Bow Island (CA); Systematic Design Services Ltd, Calgary (CA)

( * ) Notice: Subject to any disclaimer, the term of this patent is extended or adjusted under 35 U.S.C. 154(b) by 0 days.

(21) Appl. No.: 09/890,083

(22) PCT Filed: Feb. 7, 2000

(86) PCT No.: PCT/CA00/00114

§ 371 (c)(1),
(2), (4) Date: Jul. 25, 2001

(87) PCT Pub. No.: WO00/48910

PCT Pub. Date: Aug. 24, 2000

(30) Foreign Application Priority Data

Feb. 15, 1999 (CA) ..... 2262276

(51) Int. Cl.[7] ..... B65B 43/26; B65B 7/00

(52) U.S. Cl. ..... 53/459; 53/457; 53/467; 53/468; 53/469; 53/570; 53/572; 53/373.6; 53/385.1

(58) Field of Search ..... 53/457, 459, 467, 53/468, 469, 570, 571, 572, 573, 373.6, 384.1, 385.1

(56) References Cited

U.S. PATENT DOCUMENTS

| | | | | | |
|---|---|---|---|---|---|
| 2,514,867 | A | * | 7/1950 | Howard et al. | 53/373.6 |
| 3,241,290 | A | * | 3/1966 | Ingleson et al. | 53/373.6 |
| 3,559,372 | A | * | 2/1971 | Cerioni | 53/373.6 |
| 3,822,527 | A | * | 7/1974 | Germunson et al. | 53/572 |
| 3,889,449 | A | * | 6/1975 | Membrino | 53/572 |
| 4,124,966 | A | | 11/1978 | Wilson | |
| 4,172,349 | A | | 10/1979 | Lipes | |
| 4,253,292 | A | * | 3/1981 | Lipes | 53/572 |
| 4,423,583 | A | * | 1/1984 | Carey | 52/373 |
| 4,541,226 | A | | 9/1985 | Nausedas | |
| 4,651,506 | A | | 3/1987 | Lerner et al. | |
| 4,726,170 | A | | 2/1988 | Sawa et al. | |
| 4,947,625 | A | | 8/1990 | Zike | |
| 5,087,234 | A | | 2/1992 | Prader et al. | |
| 5,142,846 | A | * | 9/1992 | Alameda | 53/573 |
| 5,177,939 | A | * | 1/1993 | Lipes | 53/572 |
| 5,442,898 | A | * | 8/1995 | Gabree et al. | 53/572 |
| 5,452,559 | A | * | 9/1995 | Lipes | 53/572 |
| 5,626,550 | A | | 5/1997 | Amero et al. | |
| 5,802,817 | A | * | 9/1998 | Hood | 53/573 |
| 5,813,196 | A | * | 9/1998 | Page et al. | 53/469 |

FOREIGN PATENT DOCUMENTS

| | | |
|---|---|---|
| CA | 2091471 | 9/1993 |
| EP | 0 060 914 | 9/1982 |

* cited by examiner

*Primary Examiner*—John Sipos
*Assistant Examiner*—Louis Huynh
(74) *Attorney, Agent, or Firm*—Collard & Roe, P.C.

(57) ABSTRACT

Automated apparatus for filling of a bag with a loose commodity comprises a bag filling station for dispensing commodity into a bag; a wicket for feeding a stacked and interconnected array of empty bags; and a conveyor for removing filled bags from the filling station. Reciprocating clamps grip the open mouths of the filled bags, and transfer the filled bags away from the filling station, with a subsequent bag being drawn into appropriate position for filling by means of the connection formed between the contacting bags.

11 Claims, 17 Drawing Sheets

BAG FILLING APPARATUS AND METHOD

CROSS REFERENCE TO RELATED APPLICATIONS:

Applicants claim priority under 35 U.S.C. §119 of Canadian Application No. 2, 62,276 filed Feb. 15, 1999. Applicants also claim priority under 35 U.S.C. §120 of PCT/CA00/00114 filed Feb. 7, 2000. The international application under PCT article 21 (2) was published in English.

FIELD OF THE INVENTION

This invention relates to packaging technology, and in particular to an apparatus and method for filing bags with a loose commodity such as seed or grain, by means of an automated apparatus, and carrying the filled bags to a bag sealing station or other processing means.

BACKGROUND OF THE INVENTION

The bagging of bulk commodities such as seed or grain requires automated equipment for sequentially dispensing a measured quantity or weight of a commodity into an open-topped bag, and transferring the bag to a heat sealing station or other bag-sealing means. Typically in apparatus of this nature, the bulk commodity is dispensed from a hopper into an open-topped bag. After a measured amount is dispensed, the bag is removed from the hopper and discharged from the apparatus. Typically, individual bags are positioned beneath the hopper sequentially. Modern commodity-handling operations require bag filling machines that are capable of operating rapidly and effectively, that is, with a minimum of skipped bags (wherein a bag is missing when the hopper discharges it s load), torn or damaged bags, or doubled-up bags.

Typically, rapidity and precision are achieved by means of an automated device having moveable fingers or other gripping members for manipulation of individual bags before, during and after the filling operation. For example, published Canadian Application 2,091,471 (Huwelmann) discloses a bag-filling apparatus having opposed clamping mechanisms for gripping the open upper end of the bag, and holding the bag open for filling by a hopper or the like. Similarly, U.S. Pat. No. 4,172,349 (Lipes) discloses opening of a bag by means of a pair of opposed gripping members that grip opposing sides of the bag and hold it open at its mouth. A similar arrangement is disclosed in U.S. Pat. No. 4, 651,506 (Lerner et al.).

U.S. Pat. No. 4,124,966 (Wilson) discloses a bag filling apparatus having an overhead hopper and a bag carrying means for positioning the bag in an open-mouth positioned beneath the hopper, and subsequently carrying the filled bag away from the hopper towards a sealing other bag closure means. The bags are gripped initially by a first pair of fingers, which are relatively broad for holding the bag in an open position, and subsequently by a second pair of fingers which are narrow, for pulling opposed ends of the bag away from each other to bring the sides of the bags close to each other, for feeding the bag into a heat seal or the like. This arrangement is complex in that it requires two pairs of moveable fingers, to carry out the separate functions of holding the bag in an open position and subsequently drawing the sides of the bag together. This two-step action makes this arrangement complicated and difficult to operate at the high speeds required of a modem packaging plant.

One requirement is that such apparatus accurately and rapidly transfer individual bags from a bag supply to a filling station and subsequently to a conveyor for transferring the bag to a heat-sealing mechanism or other bag-handling subsystem. This sequence may be efficiently carried out if the bags are transferred efficiently between the various stations.

A further specific requirement that is not adequately addressed in the prior art is for a simple, effective and rapid means whereby empty bags are individually engaged and positioned in an open-topped position to receive a bulk commodity from a hopper or other filling means.

In general terms, it is desirable to provide a simplified yet reliable and speedy mechanism whereby empty bags may be sequentially engaged and transferred in an open position to a bag-filling station, and subsequently transferred to a bag conveyor. Conveniently, the individual bags may be drawn closed as they are being fed to the downstream conveyor. Since typically the downstream conveyor feeds the bags into a heat-sealing station comprising a pair of heated rollers or belts, it is desirable that the mechanism draws the sides of the bags together to form a flattened upper region of the bag to receive a heat seal.

OBJECTS OF THE INVENTION

In light of the foregoing, it is an object of the present invention to provide an improved bag filling apparatus and method, whereby individual bags are selectively engaged and positioned for individual filling and subsequently are withdrawn from the filling station in a generally lateral direction for transfer to a downstream conveyor. It is a further object to provide a means whereby the filled bags are generally substantially closed at their upper ends as the bags are transferred to the downstream conveyor, in such a manner as to permit the bags to be conveniently heat sealed at their upper ends.

SUMMARY OF THE INVENTION

In accordance with the foregoing objects, the invention comprises in one aspect an apparatus for filling bags with a loose commodity and transferring filled bags to a processing means, of the type comprising:

a bag wicket, a bottom-opening discharge hopper, means for positioning said bags sequentially beneath said hopper and a bag gripping means for closing said bag when filled and displacing said filled bag away from said hopper; said bags having opposed sides and opposed ends. The invention is characterized over the prior art in that the hopper includes a hopper mouth insertable into the bag for holding said bag in an open position during filling;

said bag gripping means comprising a pair of fingers for insertion into an open mouth of said bag at opposed ends thereof, said fingers being independently mounted to moveable support members linked to first reciprocating drive means for driving said support members horizontally in a reciprocating diverging and converging movement, whereby when diverged said fingers grip said bag and draw the opposed sides of said bag together;

second reciprocating drive means to move said fingers vertically to lower said fingers into the open mouth of said bag; and third reciprocating drive means to retract said fingers in tandem horizontally away from said hopper while gripping said bag.

Preferably, the hopper mouth comprises. a pair of reciprocating jaw members which when in a closed position prevent release of said loose commodity, said jaw members being insertable into the mouth of said bag, and which when in an open position release said loose commodity from said hopper while holding open said bag mouth.

The hopper preferably includes drive means for displacing the hopper in a reciprocating vertical motion for insertion of said hopper mouth into said bag mouth for filling the bag and subsequent removal.

Fourth drive means may also be provided for moving said fingers in tandem generally horizontally in a direction transverse to the direction of movement of said third drive means while gripping said bag.

In another aspect, there is further provided a conveyer means for receiving filled bags from said fingers, said conveyer means comprising:

a pair of substantially co-planar rotatable cooperative belt means said belt means mounted for reciprocal converging and diverging movement whereby in a diverged position the belt means are spaced apart from each other to receive said bag, and in a converged position said belt means are sufficiently close together to grip and convey said bag therebetween; and drive means for rotatably driving at least one of said belts and for actuating at least one of said belt means between said converged and diverged positions.

Preferably, the apparatus further comprises a controller for controlling the apparatus to perform the following sequence of events:

positioning an at least partly opened bag beneath said hopper;

downward movement of said hopper, whereby said jaw members extend at least partly into an open mouth of a first of said bags and deposition of a quantity of said commodity therein;

movement of said moveable fingers laterally towards said hopper means whereby said fingers are positioned substantially over the mouth of said bags;

downward movement of said fingers into said bag;

upward movement of said hopper away from said bag;

diverging movement of said fingers to draw the mouth of said bag taut;

lateral movement of said bag away from said bag wicket thereby removing the filled bag from the wicket and drawing a second bag laterally into position beneath said hopper, and separating said bags; and transferring said filled bag to a bag sealing station.

In another aspect, the invention comprises:

a method for filling a bag with a loose commodity and transferring said filled bag to a processing means, of the type comprising the steps of:

providing a source of loose commodity;

providing a stacked array of flattened bags on a wicket means and sequentially releasing an individual bag towards said source of loose commodity, said bags each having a mouth, two opposed sides and opposed ends;

sequentially opening said bags and dispensing a selected quantity of said commodity therein;

transferring filled bags away from said source, to a downstream conveyor or processing means.

The invention is characterized over the art by:

providing said bags in an interconnected array;

sequentially withdrawing said filled bags away from said commodity source in a horizontal direction away from said wicket means, while said filled bag is connected to a second empty bag thereby drawing said second of said interconnected bags under said source for filling with said loose commodity; and subsequently transferring said filled bag in a generally horizontal direction towards said conveyor or downstream processing means.

Preferably said bags are interconnected to form a continuous web by means of generating between the bags a static electrical charge or surface tension for releasably holding neighboring bags together.

Preferably, the step of providing a source of a loose commodity, comprises providing a hopper having an upper region for receiving said loose commodity and a lower region defined by a pair of reciprocating jaws for releasing said loose commodity into the open mouth of a bag;

filling said hopper while said hopper is in a first, elevated position;

lowering said hopper to a second position wherein said jaw extends into the mouth of a bag; and opening said jaws to dispense said commodity while holding said bag open.

The interconnection of the bags may be achieved by a mechanical interconnection, for example interlocking edge regions of adjacent bags, or surface effects such as surface tension or electrical attraction between contacting bags.

An intermediary conveyor means may receive the filled bags from the transfer mean, to convey the bags by their upper rim to a heat sealing station or the like. The intermediary conveyor may comprise a pair of opposing elongated conveyor members, such as a pair of endless belts driven by pulleys, that diverge to receive a bag and converge to engage and transport the bag.

The step of transferring the filled bag away from the filling station may comprise transferring the filled bag in a first direction for detaching the filled bag from the subsequent bag, and subsequently in a second direction towards the processing means. Alternatively, transfers within the first and second directions may occur essentially simultaneously.

The step of transferring the filled bag may include the step of drawing the open mouth of the bag to a substantially closed configuration, by drawing apart opposed ends of the upper region of the bag, thereby drawing together the opposed sides of the bag, and delivering the substantially closed bag to the processing means.

Having thus described the invention in general terms, the invention will now be further characterized by reference to a description and illustrations of a preferred embodiment.

The directional references employed throughout this specification are in relation to the longitudinal axis of the machine comprising the direction the general direction of movement of the bags subsequent to the filling stage, i.e., from the filling station to the heat sealing station or other downstream processing means.

DETAILED DESCRIPTION OF THE PREFERRED EMBODIMENTS

Figure 1:
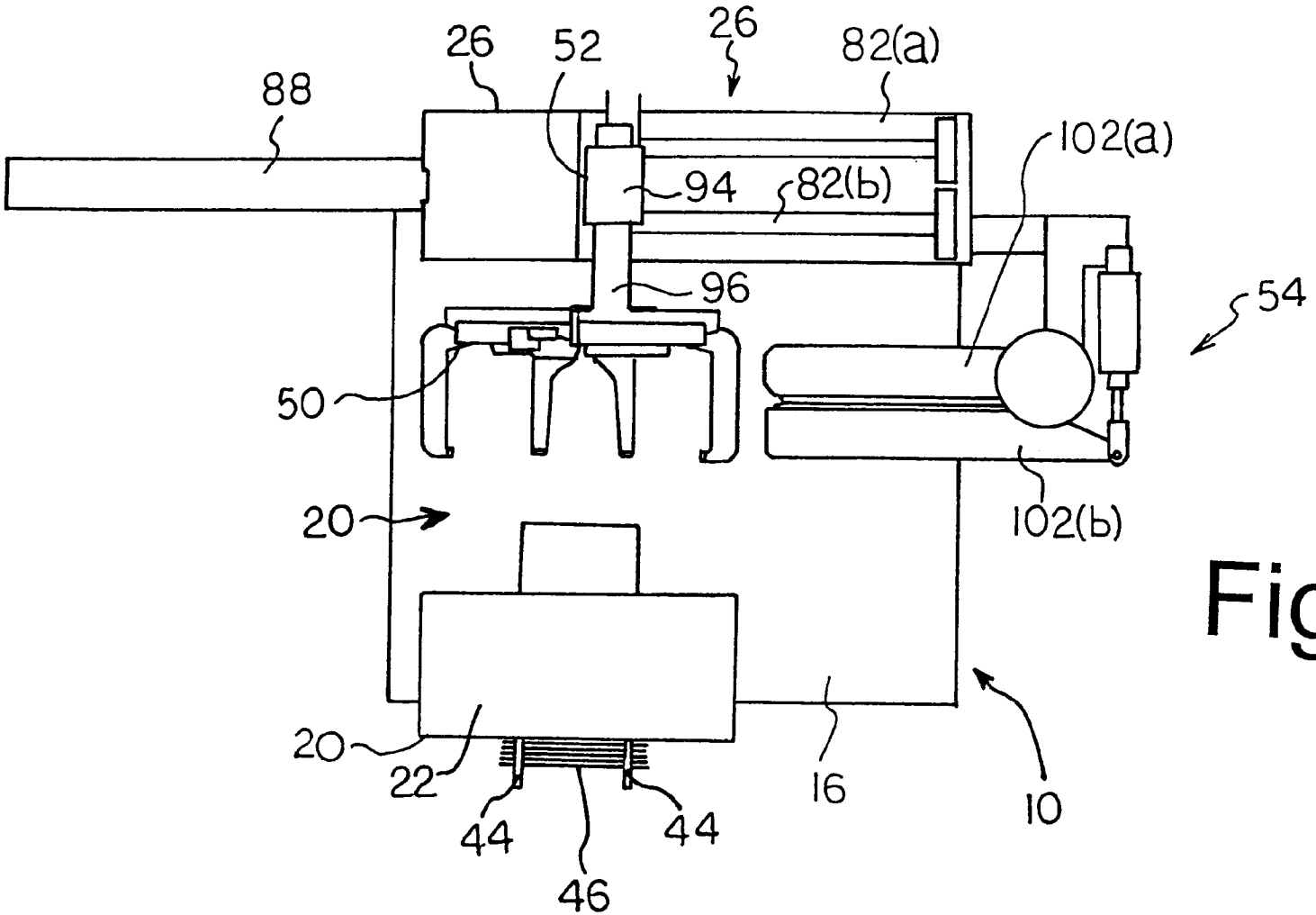
FIG. 1 is a plan view, from above, showing the apparatus according to the present invention.
Figure 2:
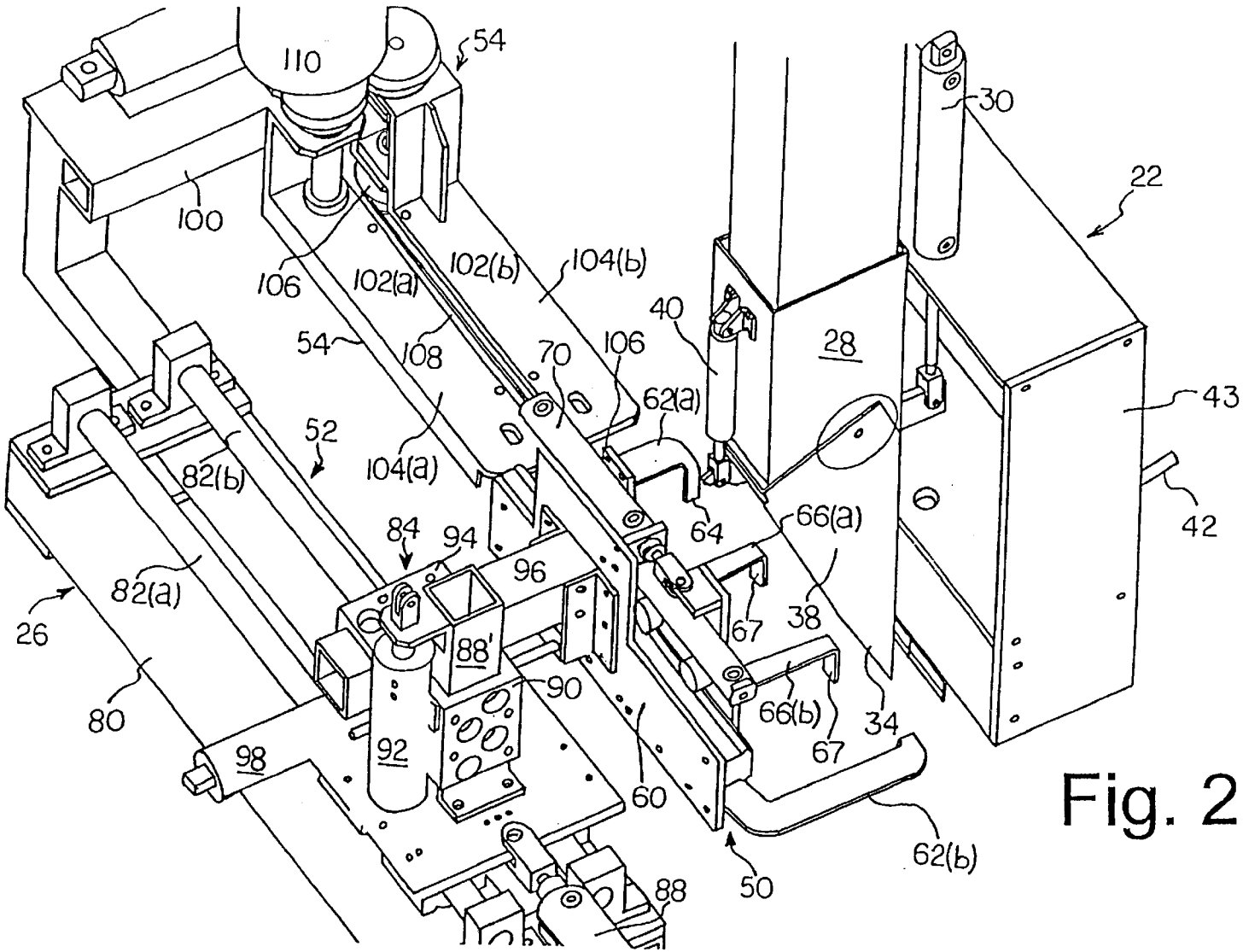
FIG. 2 is a perspective view of the apparatus, illustrating the conveyer within the closed position.

Referring to the figures, the apparatus globally denoted by reference 10 is supported on a frame 16. The apparatus comprises a bag-filling station 20, having associated therewith a bag wicket station 22 and a bag transfer station 26. The bag-filling station comprises a vertically reciprocating hopper 28, which is driven for a reciprocal vertical movement by a pneumatic drive cylinder 30. A supply conduit 32 feeds grain or other loose, bulk commodity (not shown) into the hopper 28. Release of commodity from the hopper 28 is controlled by means of an openable jaw structure 34 which defines the lower portion of the hopper and comprises a fixed jaw member 36 and a moveable jaw member 38 which pivots about a horizontal axis. The moveable jaw member 38 is driven for a reciprocal movement diverging and convergin with the fixed jaw member 36 by a pneumatic cylinder 40 mounted to the hopper 28. In the closed position, shown in FIG. 2, the respective jaw structure 34 closed and commodity cannot escape from the hopper 28. Within the open position, shown in FIG. 7(*c*), the jaw structure 34 is opened for the discharge of a measured amount of commodity from the hopper 28.

The bag wicket station 22 comprises a generally box-like support structure 43 mounted to the frame 16, and which slidably engages the hopper 28. The pneumatic cylinder 30 driving the hopper is mounted to an upper portion of the support structure 43. The wicket station 22 features a pair of wicket members 44, from which may be hung a flattened stack of empty bags 46 for filling with the commodity. The wicket members are angled downwardly to urge the bags towards the filling station via gravity. A pair of holes 48 extend through the upper rim portion of the bags 46 adjacent opposed sides thereof, to engage the wicket members 44. The bags 46 are interconnected to form an endless web or chain.

Figure 8:
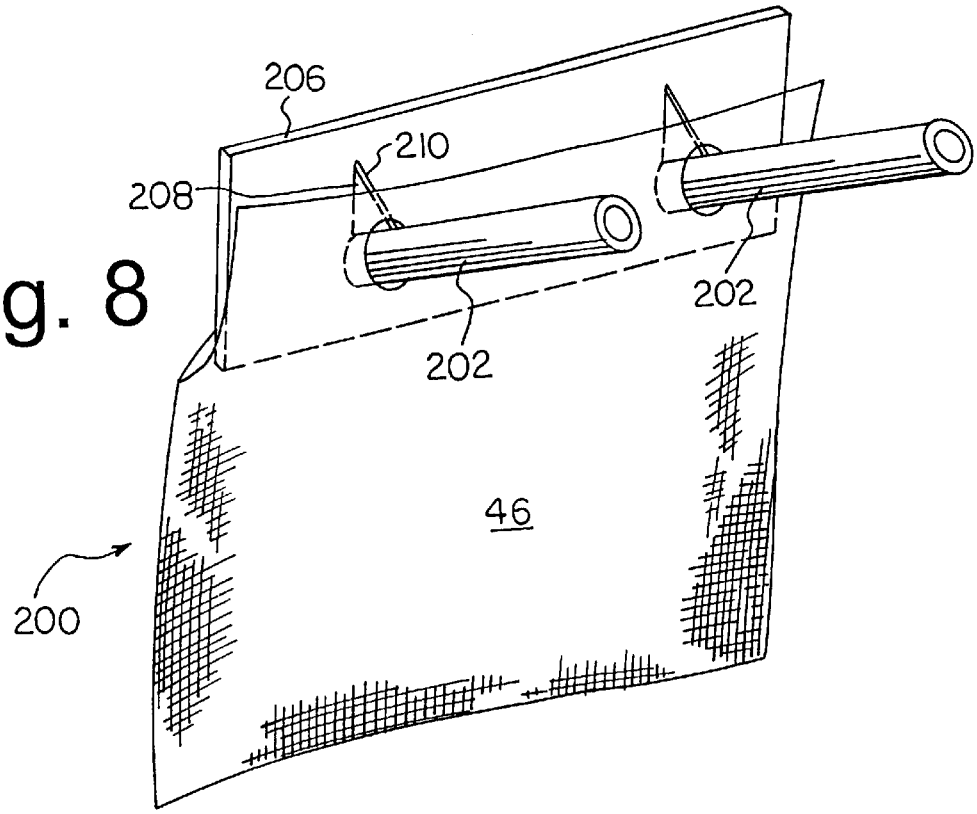
FIG. 8 is a perspective view of a portion of the device, illustrating a further embodiment of one aspect thereof.
Figure 10:
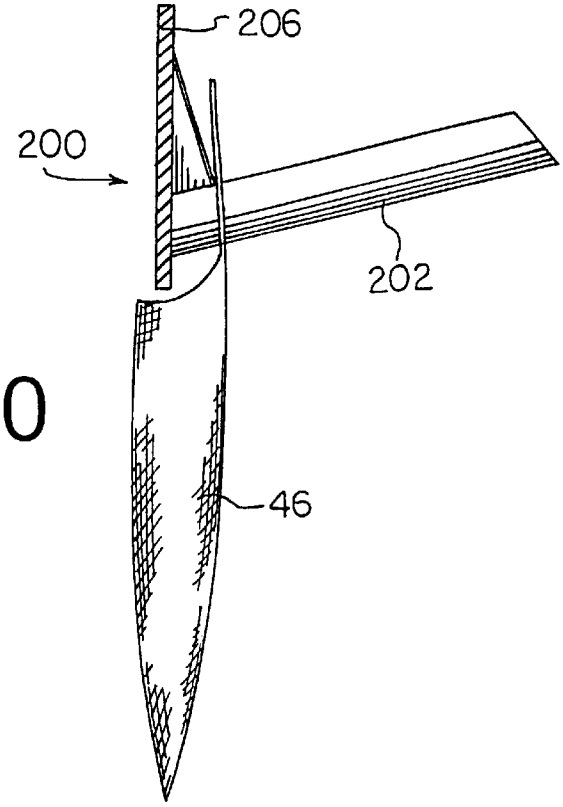
FIG. 10 is a side elevational view of the portion shown in FIG. 8.
Figure 9:
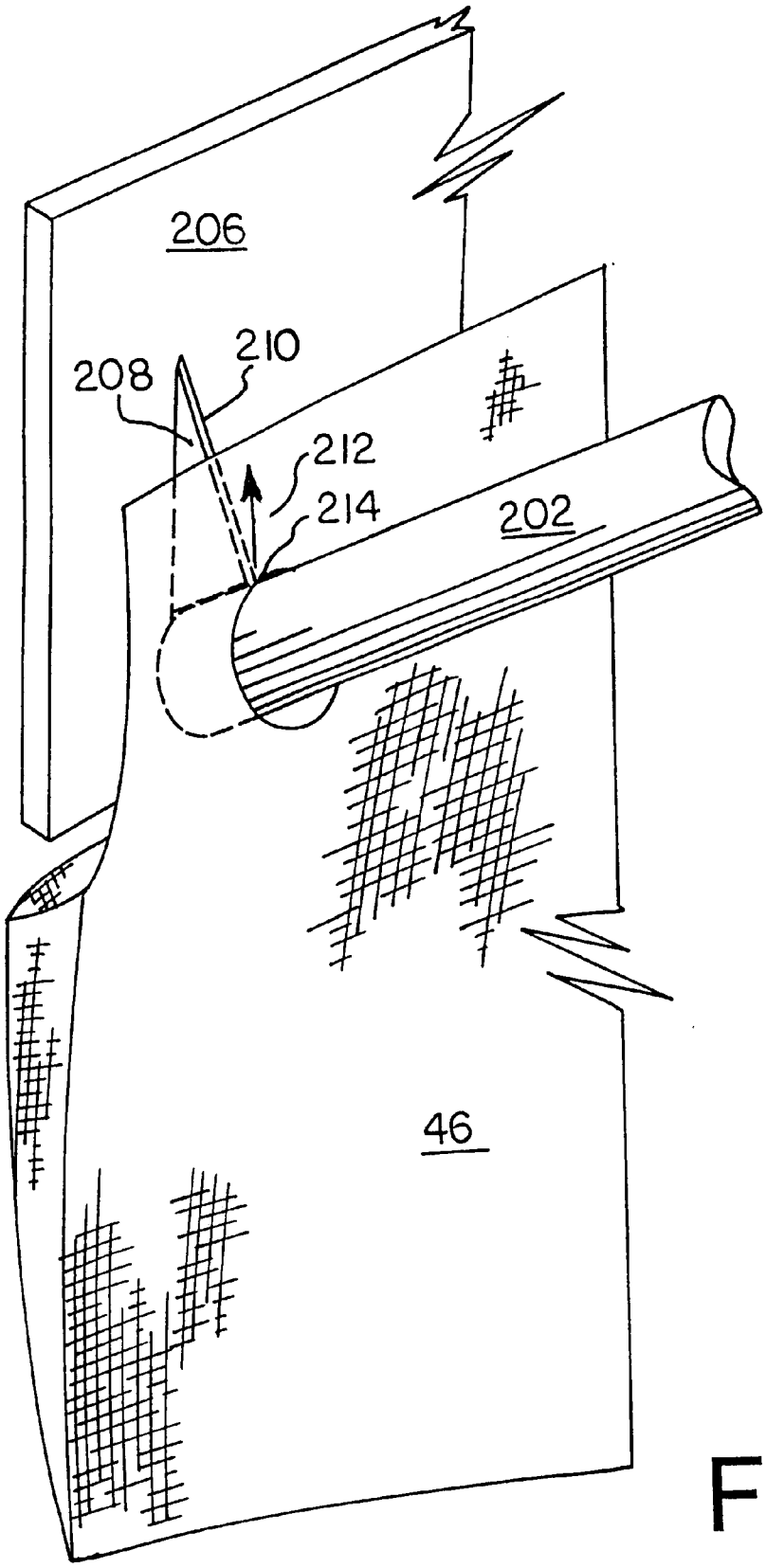
FIG. 9 is a further perspective view as in FIG. 8.

In a further aspect, an alternative arrangement of the wicket station is shown in FIGS. 8 through 10. Within this version, a wicket station 200 comprises paired wicket arms 202, which are angled downwardly towards the feeding station to feed the bags 46 via gravity towards the feeding station. The wicket arms 202 terminate at a plate like wicket knife assembly 206, mounted to the wicket station 22. A wicket knife 208 forms a gusset like web between the plate 206 and the wicket arms 202. The wicket knife has a knife edge 210 for slicing the bags as the same are drawn forwardly for removal from the wicket. Use of the wicket knife assembly, and consequent cutting of the bag, permits easier removal of the bags from the wicket with less stretching than a simple tearing action against the rounded wicket arms. FIG. 9 illustrates with arrow 212 the direction of tearing of the bag as the same is pulled forwardly off the wicket, with the tear origin occurring at point 214 on the bag.

Conveniently, the interconnection may result from surface tension, static or electrical forces between the bags or mechanical forces achieved by deformation of a portion of the bags surrounding the holes, which permits each bag to lightly grip its neighbours. The interconnection between the bags is sufficient to permit each bag to draw it's neighbour forwardly and open the mouth of the neighbouring bag, as each bag is removed from the wicket upon filling. The term "interconnection" encompasses a physical connection formed by eg. deformation of adjacent bags forming an interlocking structure, or surface effects such as surface tension forming a connection between adjacent bags.

The bag transfer station 26 comprises in general terms a bag gripper assembly 50; a gripper carriage assembly 52; and a bag conveyer station 54. The gripper assembly 50 is adapted to grip individual bags 46 and position each bag sequentially beneath the hopper 28 for filling with the commodity. Upon filling of the bag 46, the gripper assembly 50 and its associated carriage assembly 52 carry the bag to the conveyer station 54 which in turn receives the filled bag for conveyance to a heat sealing station or other downstream processing means.

The gripper assembly 50 comprises a generally plate-like vertical base 60. A pair of fixed arms 62(*a*) and (*b*) extend laterally from either end of the base 60 towards the hopper 28. Each of the outer arms 62 terminates in a downwardly-extending finger 64. The fingers 64 are adjustable on the arms 62 to accommodate bags of differing sizes requiring a greater or lesser spread of the fingers 64 to hold the bags generally taut. Positioned between the fixed outer arms 62 and parallel thereto is a pair of moveable inner arms 66(*a*) and (*b*), having a similar configuration and each terminating in a downwardly depending finger 67. The inner arms 66 are each mounted to the base 60 for slideable movement relative to the base 60. The inner arms 66 are each connected to a corresponding pneumatic cylinder 70 mounted to the base 60, with the cylinders adapted to drive the inner arms 66 between reciprocating converging and diverging positions. The inner arms 66 are reciprocate between a converged first position, shown in FIG. 7(*a*), wherein the fingers 67 of the inner arms 66 are spaced substantially apart from the fingers 64 of the fixed outer arms 62, and a second diverged position, shown in FIG. 7(*b*), wherein the respective fingers 64 and 67 of the inner and outer arms meet to clampingly engage a bag 46 therebetween.

It will be understood that the linear reciprocating motion of the cylinders 70, as well as all other like drive means, may be replaced by any suitable drive means including rotary drive means such as a revolving wheel, with the driven member being pivotally mounted at a position adjacent the wheel perimeter for reciprocating sinusoidal movement.

The carriage assembly 52 is adapted to carry the gripper assembly 50 in three axis of movement, namely laterally, longitudinally and vertically. The carriage assembly 52 comprises a carriage frame 80, mounted to the apparatus frame 16. The carriage frame includes a pair of spaced apart parallel bars 82(*a*) and (*b*) which are fixedly mounted to the frame 16 along a longitudinal axis. A carriage 84 engages the bars 82, and includes a pair of sleeves 85 for slideable receiving the bars to permit the carriage 84 to slide longitudinally along the bars 82. A reciprocating pneumatic cylinder 88 mounted at one end to the carriage 84 and at the opposing end to the apparatus frame 16 drives the carriage 84 within a longitudinal direction. Extending upwardly from the carriage 84 is a rectangular pillar 88'. A corresponding rectangular sleeve 90 is slideably received on the pillar and is driven vertically relative to the support by means of a reciprocating pneumatic cylinder 92 mounted to the respective members. Mounted to a side of the sleeve 90 is a second, horizontally-oriented rectangular sleeve 94, the axis of which is in the lateral direction. The second sleeve 94 slidingly receives a beam 96, one end of which in turn is mounted to the base of the gripper assembly 50. Lateral reciprocating movement of the gripper assembly 50 relative to the carriage 52 is achieved by means of slidable movement of the beam 96 within the second sleeve 94, which in turn is driven by a pneumatic cylinder 98 linking the respective members. Vertical movement of the gripper assembly 50 is achieved by operation of the pneumatic cylinder 92.

Figure 3:
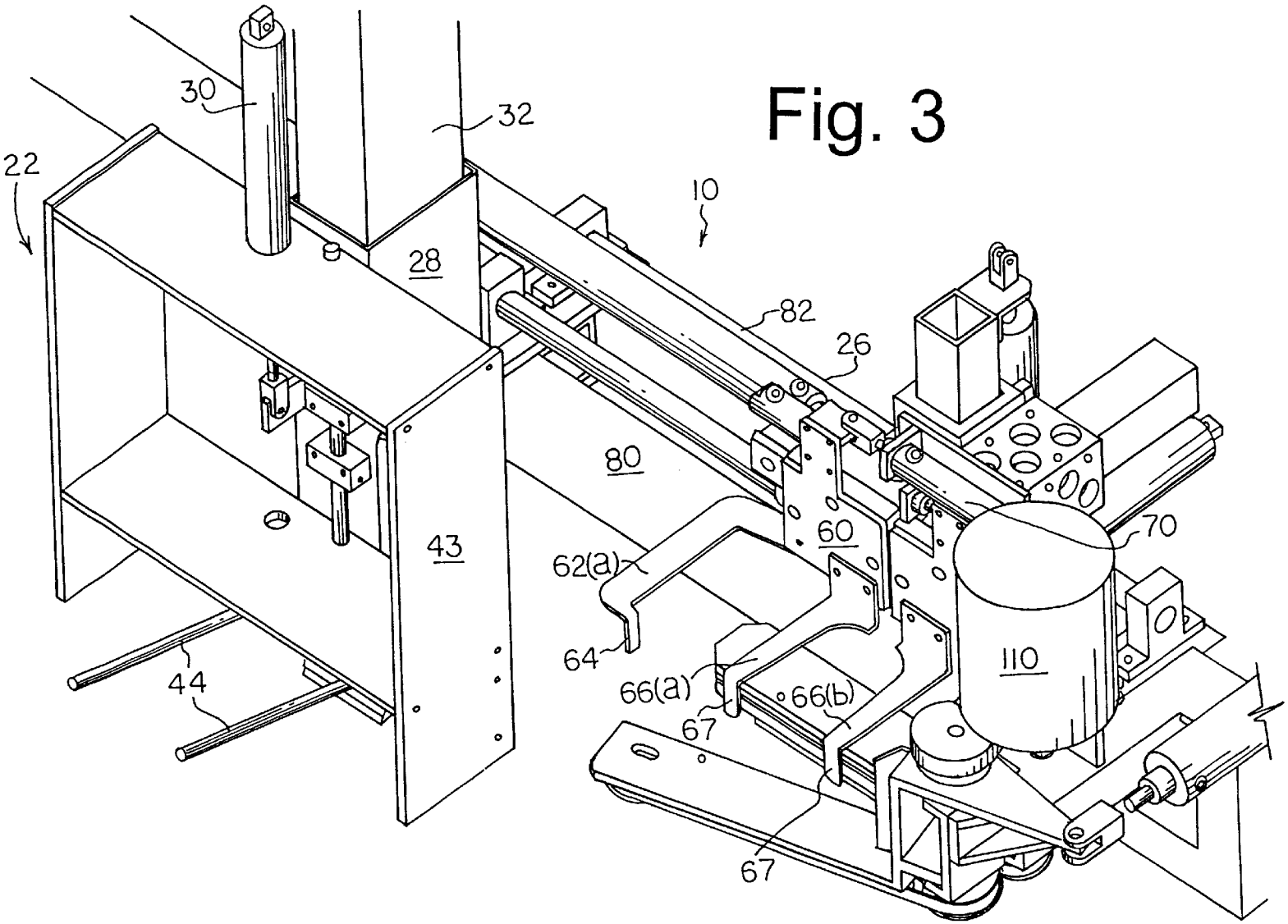
FIG. 3 is a further perspective view, illustrating the conveyer within an open position.
Figure 4:
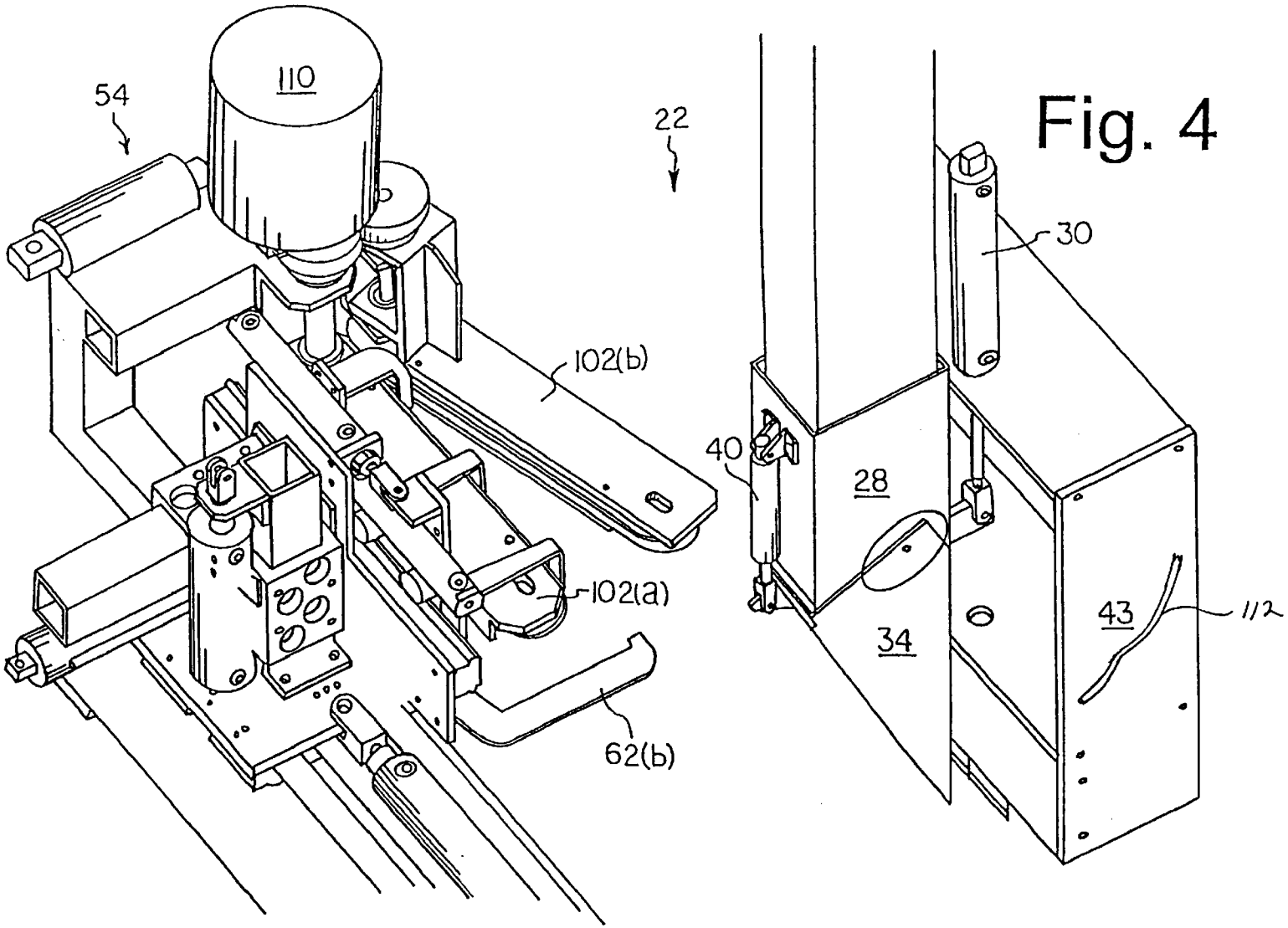
FIG. 4 is a further perspective view of the apparatus.
Figure 5:
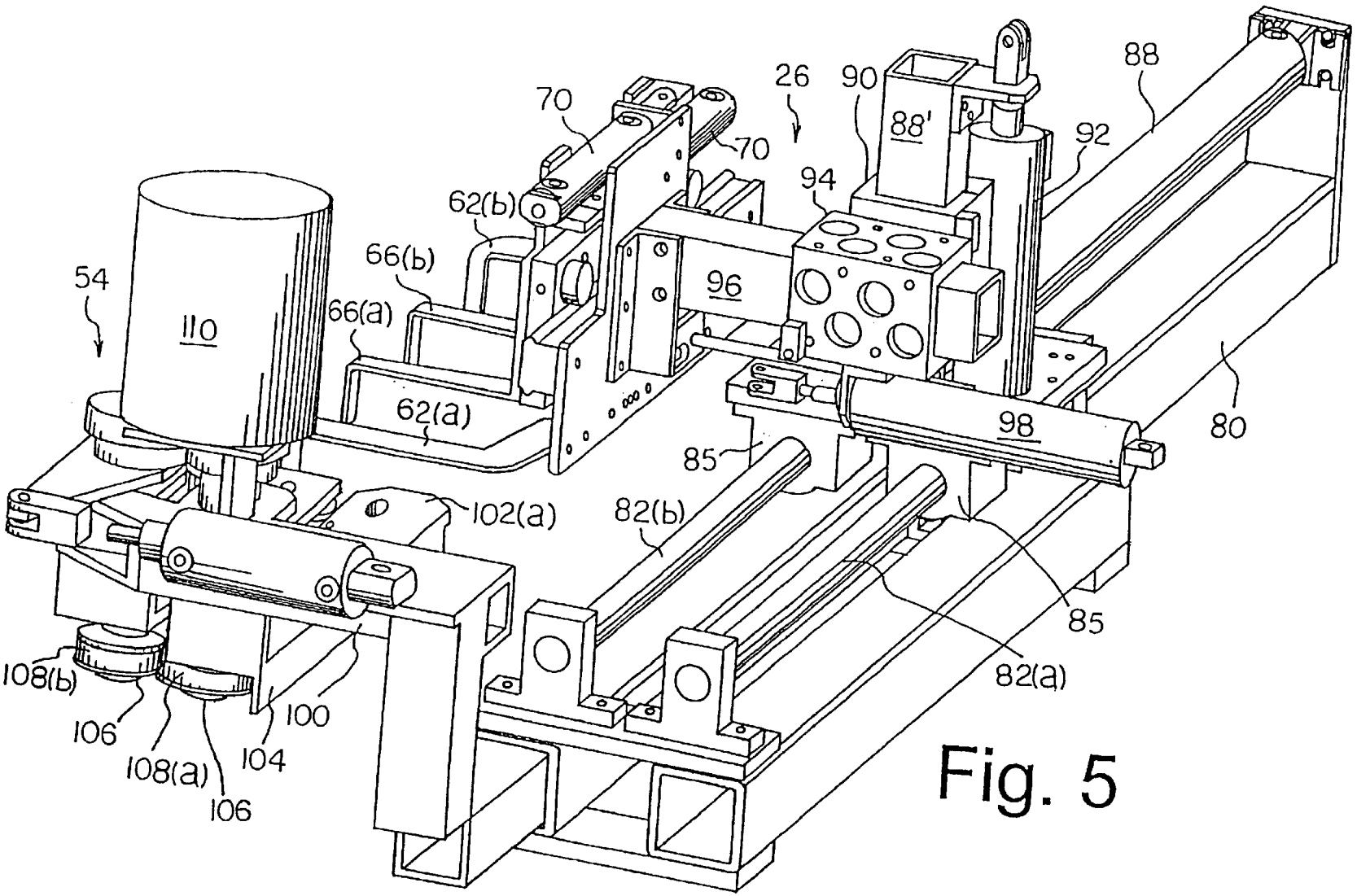
FIG. 5 is a further perspective view of the apparatus.
Figure 6:
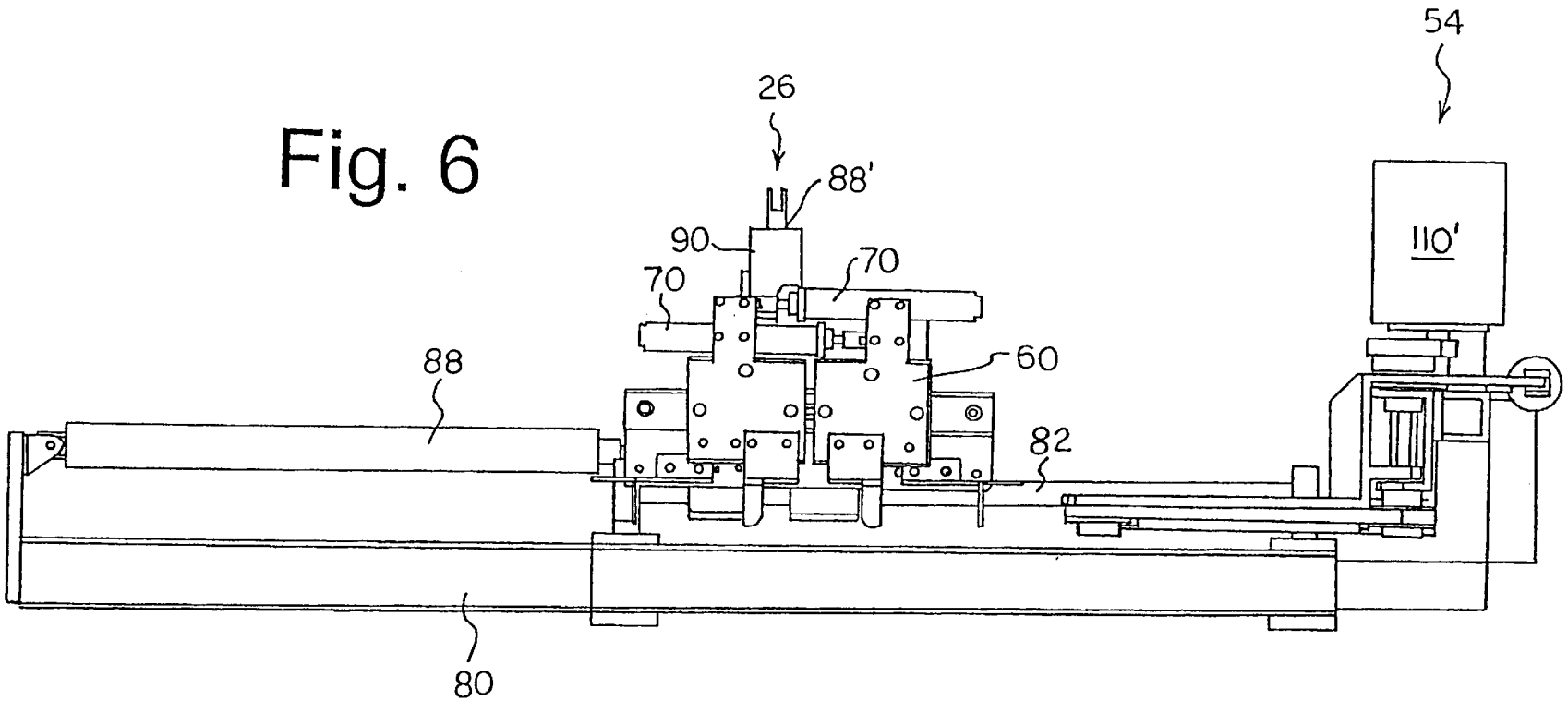
FIG. 6 is a side elevational view of a portion of the apparatus.

The conveyer station 54 is mounted to the carriage assembly 52 by means of a beam arrangement 100. The conveyer station 54 comprises a pair of generally co-planer belt assemblies 102(*a*) and (*b*). The belt assemblies 102 each comprise a housing 104, having journalled therein a pair of rotatable pullies 106 at either end thereof, supporting the opposing ends of a rotatably driven belt 108. A motor 110 drives both the first of the belts 108(*a*) and 108(*b*). The respective belts are geared together through meshing spur gears mounted on corresponding belt drive shafts. The first housing 104(*a*), with the motor 110 mounted thereto, is fixed to the beam arrangement 100. The second housing 104(*b*) is pivotally mounted to the beam arrangement 100 for pivoting about a vertical axis. When the respective housings 104(*a*) and (*b*) are swung together within the closed position, the respective belts 108(*a*) and (*b*) are parallel to and in substantial contact with each other. Within the open position shown in FIG. 3, the belts 108 diverge. When in the diverged position, the belts are able to receive a filled bag, and subsequently swing together in to the closed position for conveyance of the bag away from the apparatus.

Figure 7:
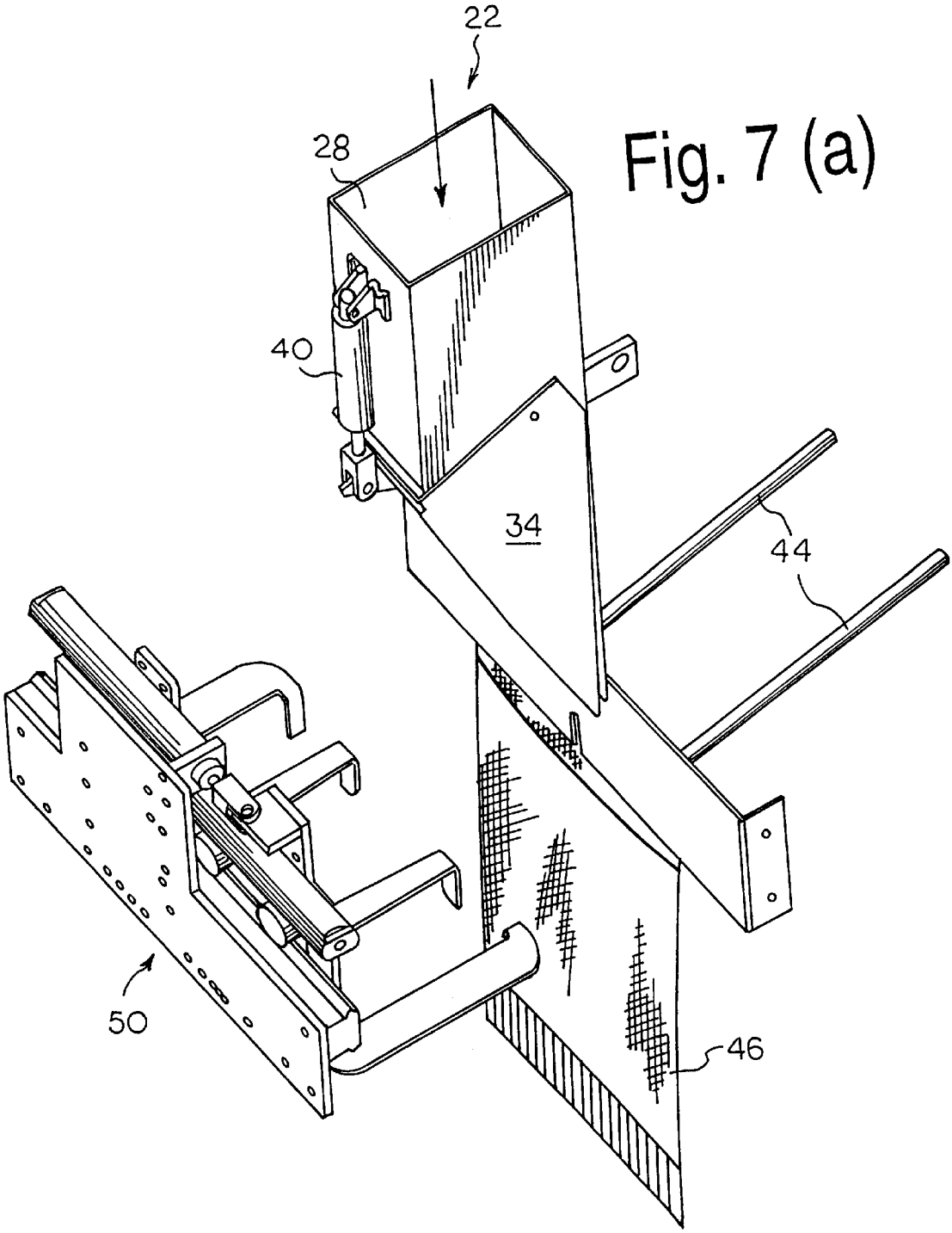
FIGS. 7*a* through *i* comprise a series of perspective views, of a portion of the apparatus, illustrating operation of the apparatus.
Figure 7:
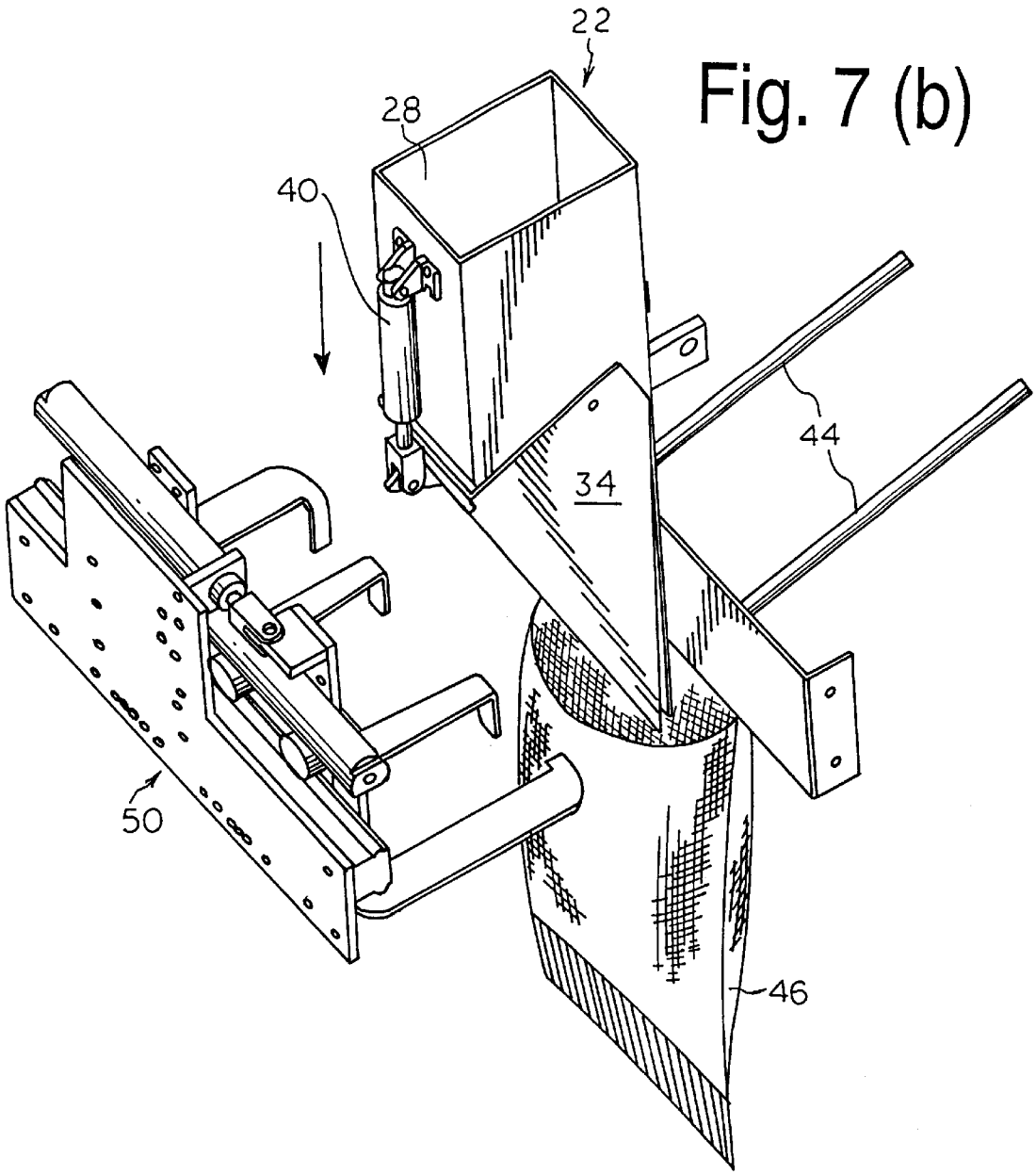
Figure 7:
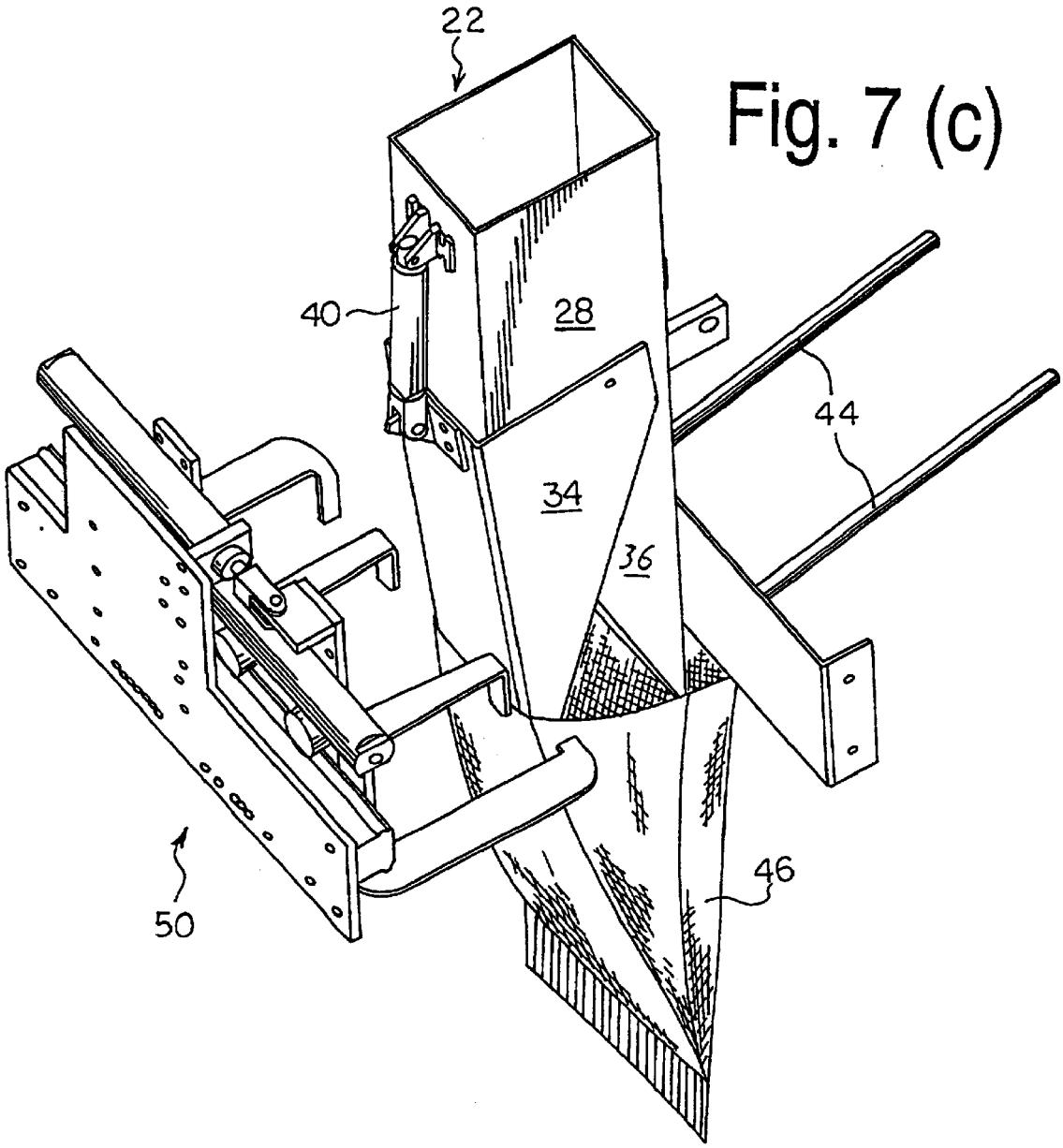
Figure 7:
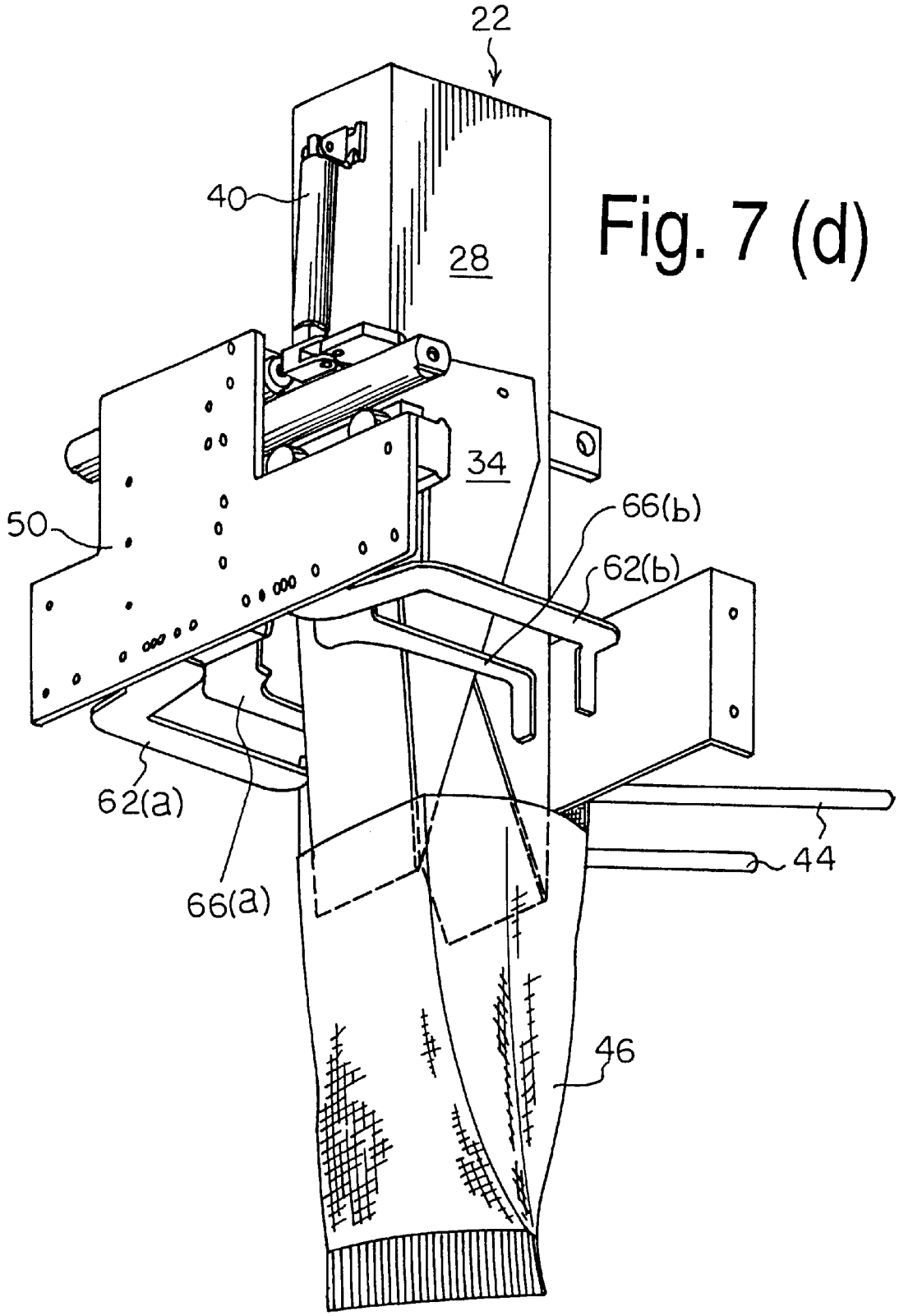
Figure 7:
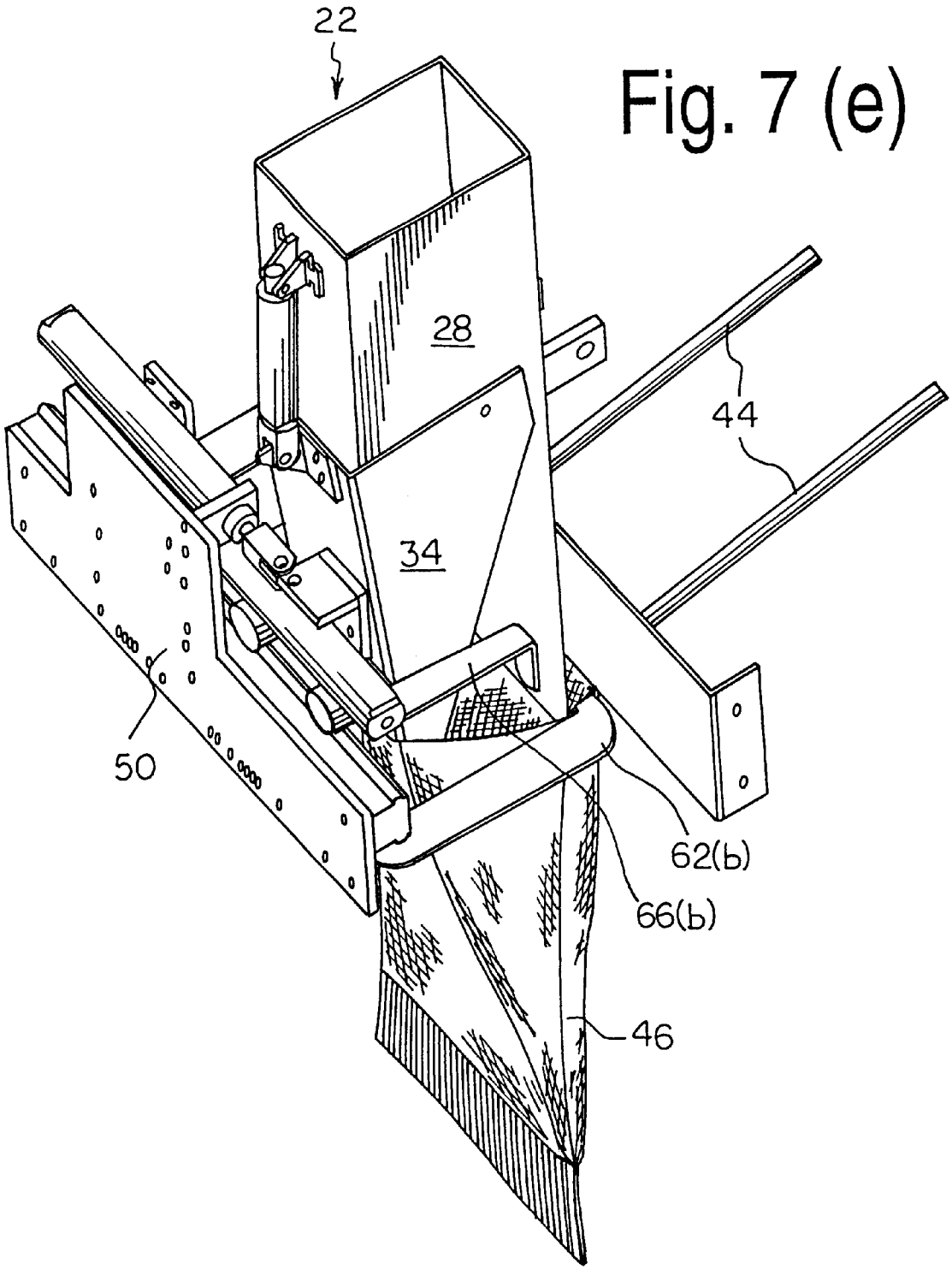
Figure 7:
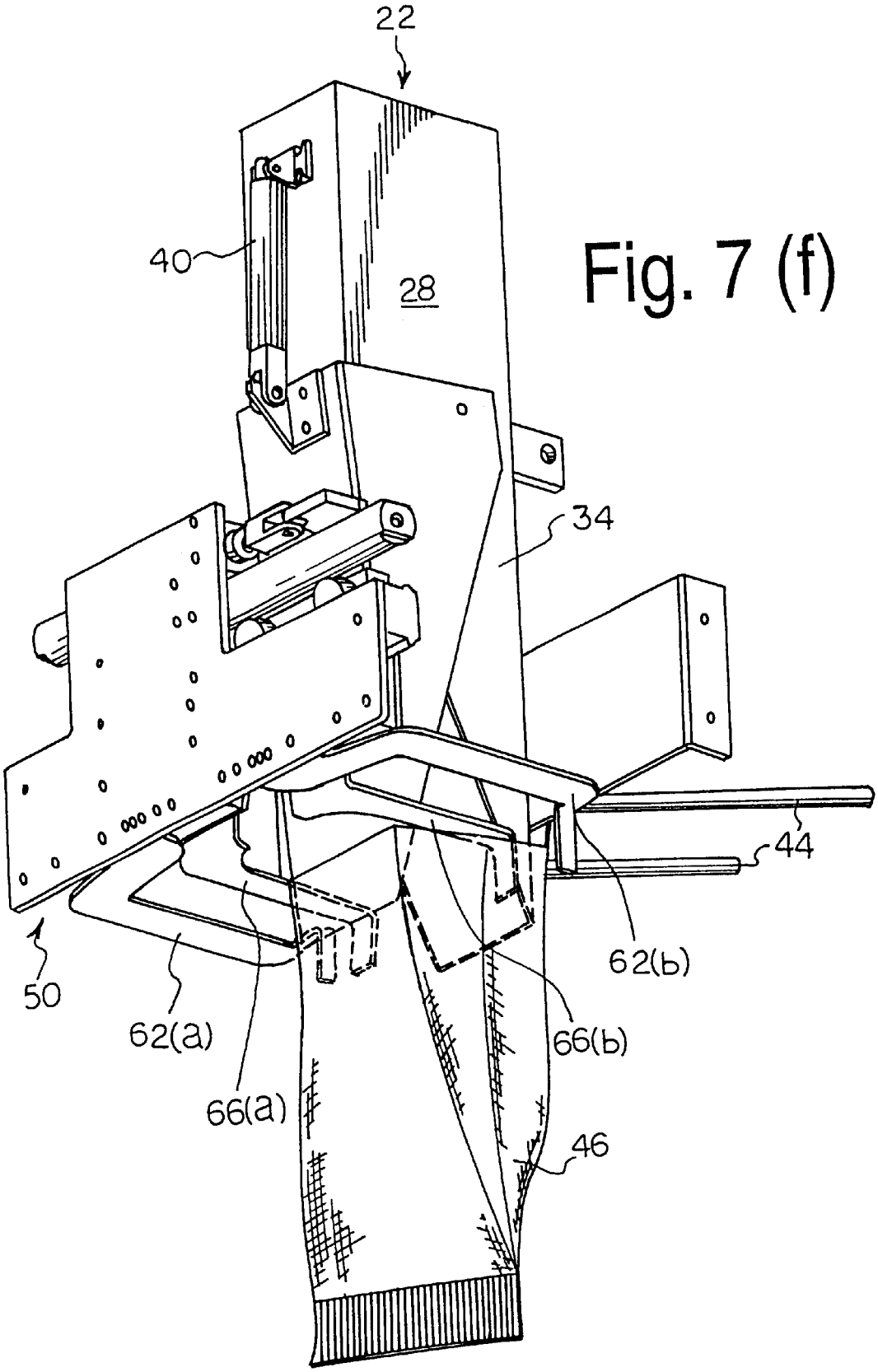
Figure 7:
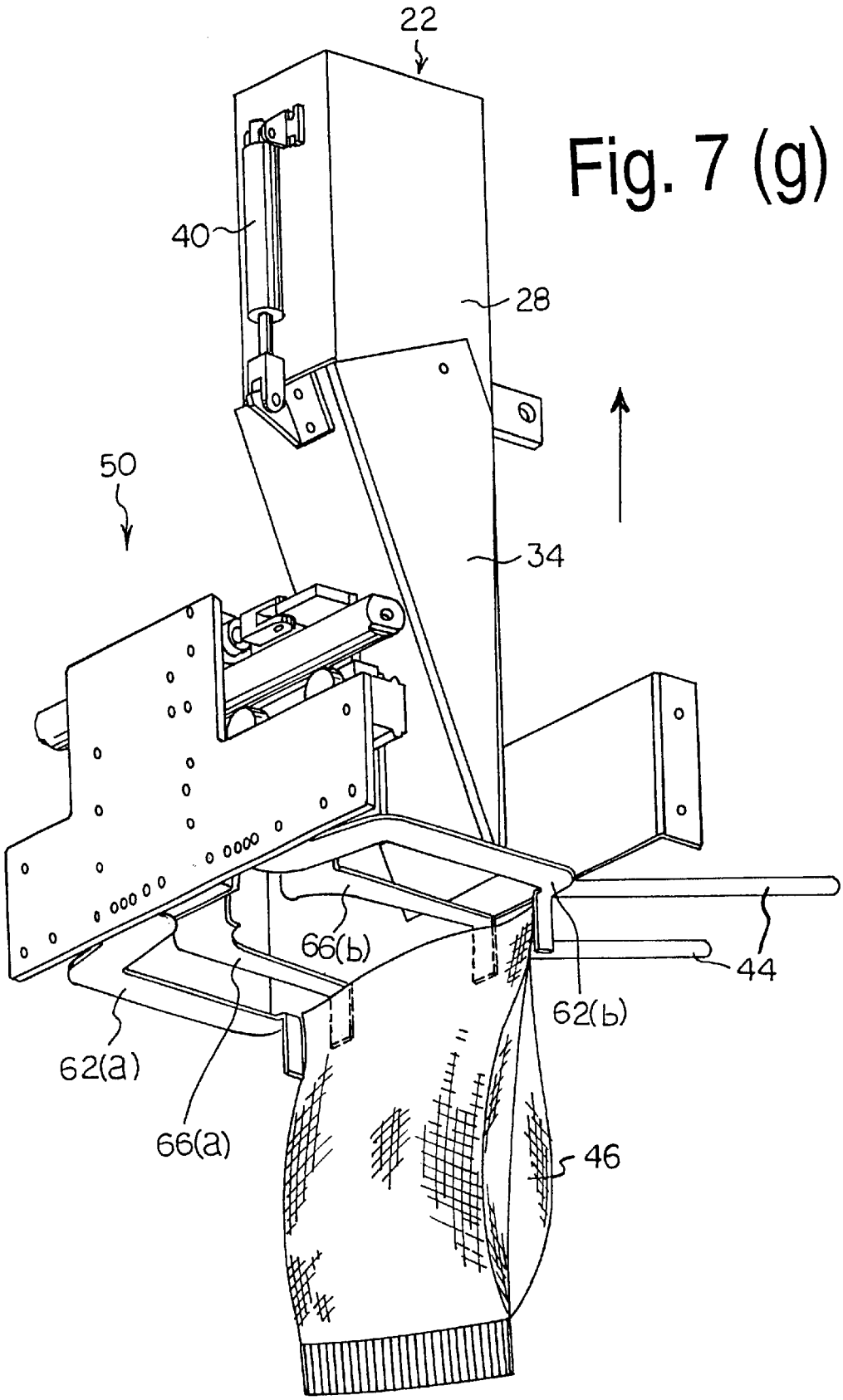
Figure 7:
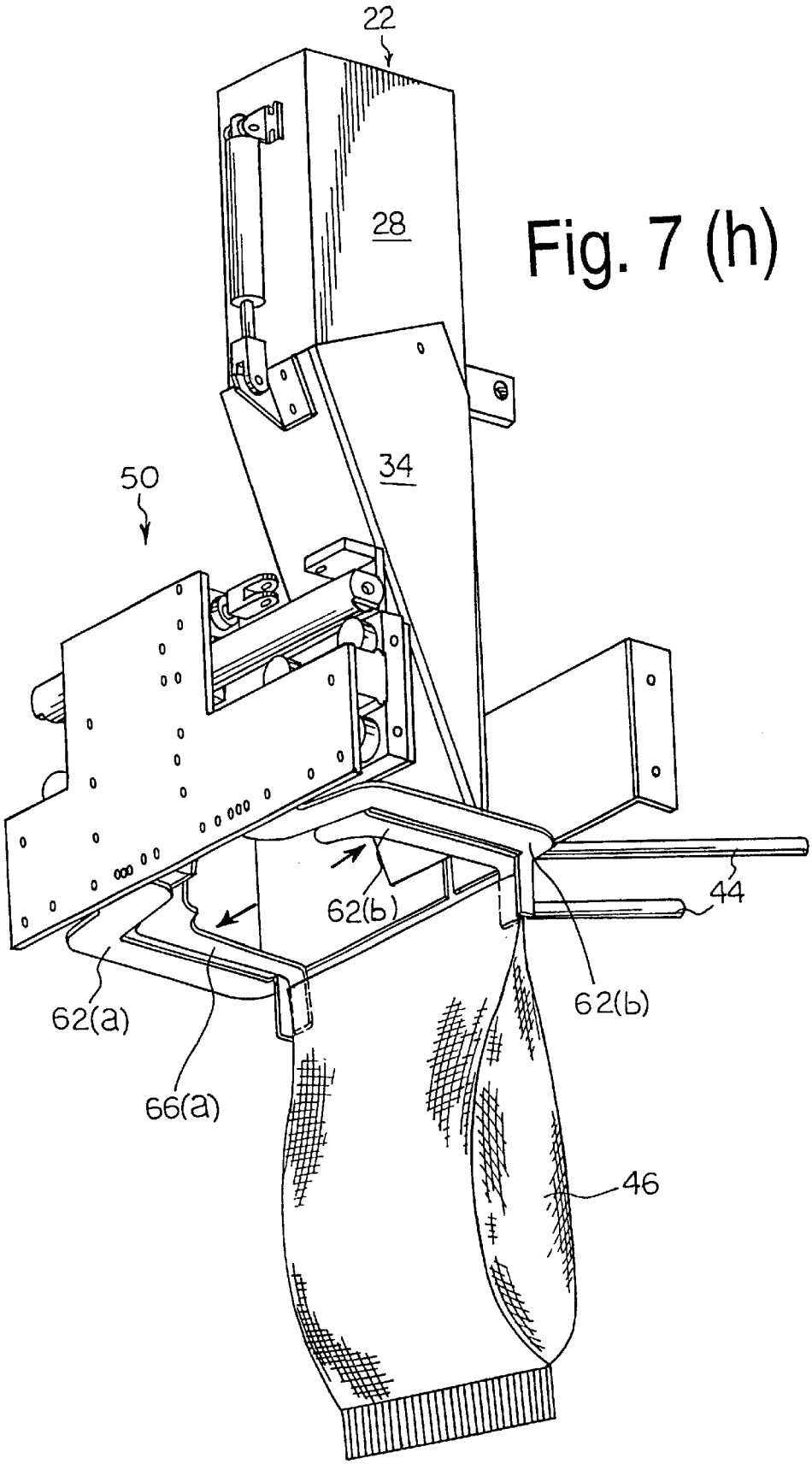
Figure 7:
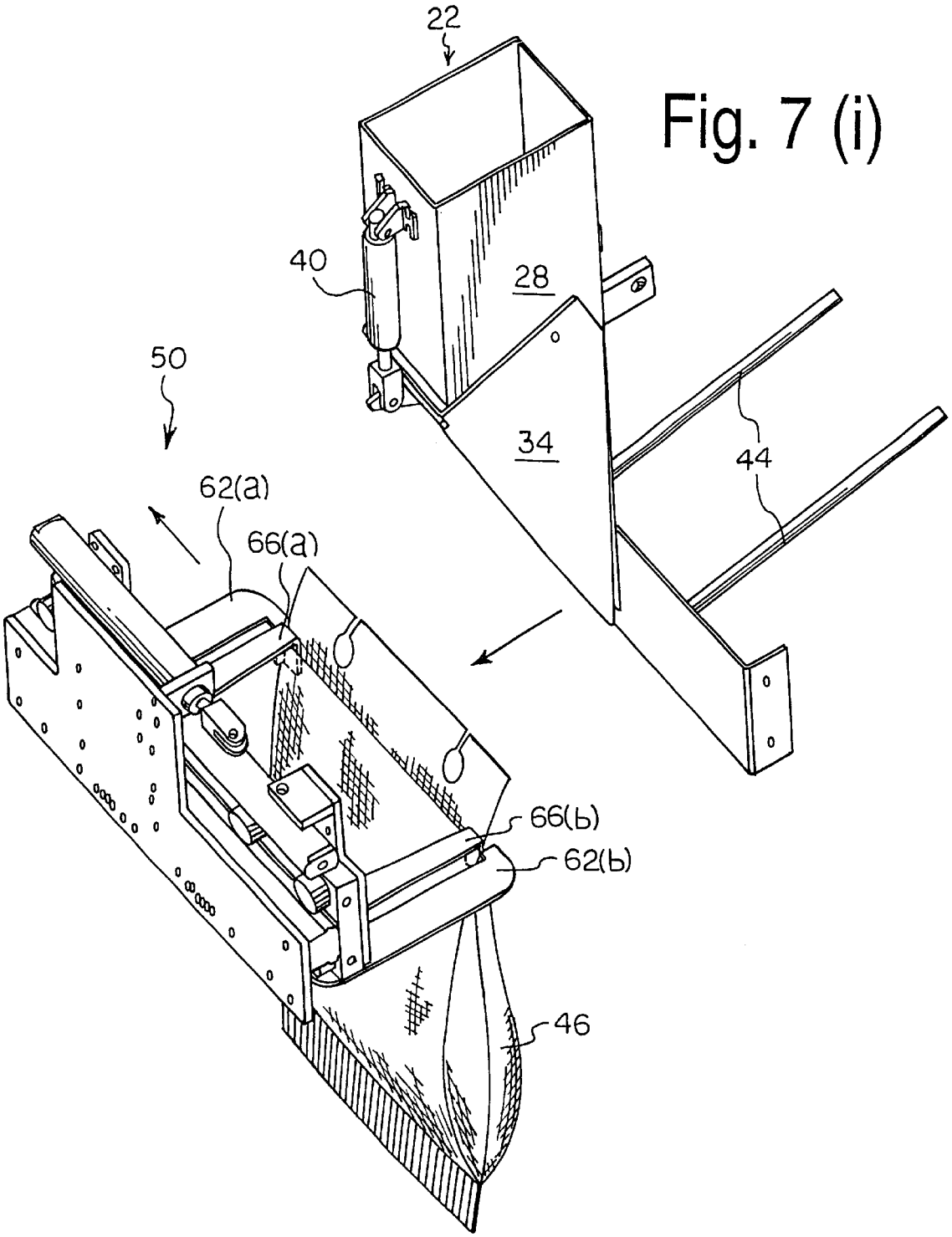

Operation of the devise will now be described by reference to FIGS. 7(*a*)–(*i*).

Operation of the apparatus commences with an individual bag 46, comprising the first bag in the interconnected array of bags 46, being supported by the wicket members 44 and positioned directly below the hopper 28. An air nozzle 112 mounted to the wicket support 43 directs a stream of air into the at least partly open mouth of the bag 46, to open the bag sufficiently for filling and to hold the bag open as the jaws 36 and 38 of the hopper 28 descend into the bag 46, as shown in FIG. 7(*b*). The hopper 28 then discharges a measured amount of the commodity into the bag 46. As the hopper is discharging the commodity, the bag gripper assembly 50 advances laterally towards the hopper 28, as seen in FIGS. 7(*c*)–(*e*), and subsequently downwardly, as seen in FIG. 7(*f*), such that the downwardly-depending fingers 67 of the inner arms 66 extend into the open mouth of the bag 46. The jaws 36 and 38 of the hopper 28 then close and the hopper moves upwardly, as shown in FIGS. 7(*g*) and (*h*). Simultaneously, the inner arms 67 of the gripper diverge, thereby drawing taut the mouth of the bag 46 and gripping opposing corners of the bag between the respective inner and outer fingers 64 and 67, as seen in FIG. 7(*h*). The gripper assembly 50 then retracts laterally, as seen in FIG. 7(*i*), and transfers the bag 46 longitudinally to the conveyer station 54. Retraction of the first bag 46 away from the interconnected array of bags 46 draws the subsequent bag 111 in the array forwardly in position beneath the hopper 28. The filled bag 46 is then conveyed longitudinally along the paired bars 82, towards the conveyor station 54. The paired belts 108 of the conveyer station 54 within the open position receive the bag 46, and subsequently converge to grippingly engage the bag between the respective belts 108, for conveyance towards a heat sealing station 120 or the like. Conventionally, the heat sealing station comprises a pair of heated belts which may receive the bag directly from the conveyer to perform a heat sealing operation on the bag.

Operation of the device, and in particular, operation of the various pneumatic cylinders, is controlled by a central control unit, which in includes sensors for detecting the positions of the various components referred to above, and ensuring the various pneumatic actuators operate in a coordinated fashion.

It will be seen that although the present embodiment employs reciprocating pneumatic actuators for driving the various components of the apparatus, any known drive means may be substituted, including hydraulic rams, electric linear actuators or other like means.

It will be further understood, that although the present invention has been described in detail byway of a preferred embodiment thereof, persons skilled in the art to which this invention pertains will be able to make numerous modifications and variations to the invention. These variations and modifications will still remain within the spirit and scope of the invention, which is described and characterized within the appended claims.

We claim:

1. A bag filling apparatus for filling bags with a loose commodity comprising a bag wicket (44) for holding an interconnected array of empty bags, a bottom-opening discharge hopper (28), means for positioning said bags sequentially beneath said hopper and a bag gripping means for closing said bag when filled and displacing said filled bag away from said hopper; said bags having opposed sides and opposed ends;

said hopper (28) including drive means (40) for displacing said hopper in a reciprocating vertical motion and a hopper mouth (34) insertable into said bag for holding said bag in an open position during filling;

said bag gripping means comprising a first pair of arms (62*a* and 62*b*) each terminating in a downwardly-depending finger (64*a* and 64*b*); and a second pair of arms (66*a* and 66*b*) positioned between said first pair and each terminating in a corresponding downwardly-depending finger (67*a* and 67*b*), said second pair of arms being driven by first reciprocating drive means (70) for horizontal diverging and converging movement whereby within a converged position said fingers of said second arms are positioned for insertion within an open mouth of a bag, and in said diverged position, said fingers are positioned to draw apart opposed ends of said bag, thereby drawing together the opposed sides of said bag;

second reciprocating drive means (92) to lower said fingers (67(*a*) and (*b*)) of said second pair of arms into the open mouth of said bag; and third reciprocating drive means (98) to retract said fingers and said first and second pairs of arms in tandem in a horizontal direction away from and opposite to the bag wicket (44) while gripping said bag for drawing the next empty bag from said wicket under said hopper.

2. An apparatus as defined in claim 1, wherein said hopper mouth comprises a pair of reciprocating jaw members (36 and 38) which when in a closed position prevent release of said loose commodity, said jaw members being insertable into the mouth of said bag, and which when in an open position release said loose commodity from said hopper while holding open said bag mouth.

3. An apparatus as defined in claim 2, further comprising a controller for controlling the apparatus to perform the following sequence of events:

positioning an at least partly opened bag beneath said hopper (28);

downward movement of said hopper, whereby said jaw members (36 and 38) extend at least partly into an open mouth of a first of said bags and deposition of a quantity of said commodity therein;

movement of said bag gripping means laterally towards said hopper whereby said fingers (67*a* and 67*b*) of said second pair of parallel, arms (66*a* and 66*b*) are positioned substantially over the mouth of said bag;

downward movement of said fingers of said second pair of parallel arms into said bag;

upward movement of said hopper away from said bag;

diverging movement of said fingers of said second pair of parallel arms to draw the mouth of said bag taut and grippingly engage said bag between respective fingers of said first and second pair of parallel arms;

lateral movement of said pairs of arms to withdraw said bag away from said bag wicket (44) thereby removing the filled bag from the wicket and drawing a second bag laterally into position beneath said hopper, and separating said bags; and transferring said filled bag to a bag sealing station (56).

4. An apparatus as defined in claim 1, further comprising bag-opening means (112) for initially opening said bags prior to insertion therein of said hopper mouth (34).

5. An apparatus as defined in claim 4, wherein said bag-opening means (112) comprises an air nozzle for directing a stream of air towards the mouth of said bag.

6. An apparatus as defined in claim 1, further comprising a conveyer means (54) for receiving filled bags from said fingers, said conveyer means comprising:

a pair of substantially co-planar rotatable cooperative belt means (108*a* and 108*b*), said belt means mounted for reciprocal converging and diverging movement whereby in a diverged position the belt means are spaced apart from each other to receive said bag, and in a converged position said belt means are sufficiently close together to grip and convey said bag therebetween; and drive means (110) for rotatably driving at least one of said belts and for actuating at least one of said belt means between said converged and diverged positions.

7. An apparatus as in claim 1, wherein said bag wicket angles downwardly to at least partly feed said bags to said filling station via gravity.

8. An apparatus as defined in claim 1, wherein said bag wicket further includes a blade means (206) for slicing an upper region of a filled bag as said filled bag is retracted by said pairs of arms.

9. A method for filling a bag with a loose commodity and transferring said filled bag to a processing means, comprising the steps of:

providing a source of loose commodity for dispensing from a hopper;

providing a stacked array of flattened bags on a wicket means (44) and sequentially releasing an individual bag towards said source of loose commodity, said bags each having a mouth, two opposed sides and opposed ends;

sequentially opening said bags and dispensing a predetermined quantity of said commodity therein;

transferring filled bags away from said source, to a downstream conveyor or processing means;

said method characterized by:

providing said bags in an interconnected array;

providing a hopper (28) having an upper region for receiving said loose commodity and a lower region defined by a pair of reciprocating jaws (36 and 38) for releasing said loose commodity into the open mouth of the bag;

raising said hopper to a first, elevated position;

positioning a bag under said hopper;

lowering said hopper to a second position wherein said jaws extend into the mouth of said bag;

opening said jaws to dispense said commodity while holding said bag open;

raising said hopper back to said first position;

gripping the filled bag with a bag gripping means and drawing the open mouth of said bag substantially closed, by drawing apart opposed ends of said bag, thereby drawing together the opposed sides of said bag;

and said bag gripping means comprising a first pair of arms (62*a* and 62*b*) each terminating in a downwardly-depending finger (64*a* and 64*b*); and a second pair of arms (66*a* and 66*b*) positioned between said first pair and each terminating in a corresponding downwardly-depending finger (67*a* and 67*b*);

sequentially displacing said bag gripping means to withdraw said filled bag away from said commodity source in a horizontal direction opposed to said wicket means (44), while said filled bag is connected to a second empty bag thereby drawing said second of said interconnected bags under said source for filling with said loose commodity; and subsequently transferring said filled bag in a generally horizontal direction towards said conveyor or downstream processing means (54).

10. A method as in claim 9, wherein said bags are interconnected to form a continuous web by means of generating between the bags a static electrical charge or surface tension for releasably holding neighboring bags together.

11. A method as defined in claim 9, wherein said bags are interconnected to form a continuous web by means of mechanical connection between said bags.

* * * * *